US011808554B1

(12) United States Patent
Vu

(10) Patent No.: US 11,808,554 B1
(45) Date of Patent: Nov. 7, 2023

(54) EMBEDDED MOUNTING DEVICES AND METHODS

(71) Applicant: Government of the United States, as represented by the Secretary of the Air Force, Wright-Patterson AFB, OH (US)

(72) Inventor: Daniel Vu, Niceville, FL (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 17/738,369

(22) Filed: May 6, 2022

Related U.S. Application Data

(60) Provisional application No. 63/214,431, filed on Jun. 24, 2021.

(51) Int. Cl.

| | |
|---|---|
| ***F42B 33/00*** | (2006.01) |
| ***F42B 30/00*** | (2006.01) |
| ***F42B 12/36*** | (2006.01) |
| *F42B 30/08* | (2006.01) |
| *F42B 12/20* | (2006.01) |

(52) U.S. Cl.
CPC ..... *F42B 33/001* (2013.01); *F42B 30/006* (2013.01); *F42B 12/20* (2013.01); *F42B 12/36* (2013.01); *F42B 30/08* (2013.01)

(58) Field of Classification Search
CPC ..... F42B 12/00; F42B 12/02; F42B 12/36; F42B 12/365; F42B 30/00; F42B 30/08; F42B 30/006; F42B 33/00; F42B 33/001; F42B 33/02; F42B 12/20
USPC ..... 86/51, 1.1; 102/473–500, 293
See application file for complete search history.

(56) References Cited

U.S. PATENT DOCUMENTS

| | | | | |
|---|---|---|---|---|
| 4,848,239 | A | 7/1989 | Wilhelm | |
| 6,622,629 | B2 | 9/2003 | Hodge et al. | |
| 7,111,558 | B2 | 9/2006 | Brede et al. | |
| 7,494,090 | B2 * | 2/2009 | Leal | F42B 12/58 244/3.17 |
| 7,921,774 | B1 | 4/2011 | Reynolds et al. | |
| 9,759,537 | B1 | 9/2017 | Smith et al. | |
| 11,493,313 | B2 * | 11/2022 | Moore | H05K 1/141 |

* cited by examiner

*Primary Examiner* — James S Bergin
(74) *Attorney, Agent, or Firm* — AFMCLO/JAZ; Jeffrey V. Bamber

(57) ABSTRACT

A mounting device that is used to suspend items in a specific location inside the cavity of a tubular structure, such as a munition, is disclosed. The mounting device includes: a pedestal for leading the insertion of the mounting device into a cavity of a munition and a skeletal frame. The skeletal frame defines an opening therein for holding an article inside the outermost portion of the skeletal frame. In some cases, the skeletal frame may have a fixed configuration. In other cases, the skeletal frame may be collapsible and expandable so that it may be inserted into a cavity of a munition having an obstruction therein. Methods of inserting and mounting an article inside an internal explosive cavity of a munition are also disclosed.

22 Claims, 9 Drawing Sheets

EMBEDDED MOUNTING DEVICES AND METHODS

Pursuant to 37 C.F.R. § 1.78(a)(4), this application claims the benefit of and priority to prior filed Provisional Application Ser. No. 63/214,431, filed Jun. 24, 2021, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to devices and methods for suspending articles inside of tubular structures and, more particularly, to embedded mounting devices and methods for suspending articles inside the explosive cavities of munitions.

BACKGROUND OF THE INVENTION

In some fields, devices and methods are needed for suspending articles inside of tubular structures. One field is that of manufacturing large munitions. In the field of manufacturing large munitions, it may be desirable to suspend various types of articles inside the explosive cavities of the munitions.

For example, embedded firesets are currently being developed as a replacement for traditional fuzing in large munitions. The current methods require multi-pour operations where the embedded items are held in position by bracketing. The explosive is poured to the height at which the fireset sits. The fireset(s) are then held in place by a bulky rigid bracket to partially submerge the firesets in the fill. From there, the explosive is then allowed to cure to provide stability to the embedded fireset. Post cure, the brackets are removed and the remaining cavity is filled with explosives, or in the case of multiple embedded firesets, the cavity is filled to the next interface. In another method, the explosive is cured in mold halves that are aligned with the axial plane of the munition, and the embedded firesets are held in place by brackets while the explosive is cured. Post-cure, the brackets are removed and the explosive billet is then transferred to its final chamber and the remaining fill is then added to encapsulate the other side.

Therefore, a need exists for improved mounting devices and methods for suspending articles inside the explosive cavities of munitions. In particular, a need exists for improved mounting devices and methods that are suitable for suspending articles inside the explosive cavities of munitions so that an explosive can be poured into the explosive cavity using a single pour operation and can be cured in place around the article.

SUMMARY OF THE INVENTION

The present invention relates generally to devices and methods for suspending articles inside of tubular structures and, more particularly, to embedded mounting devices and methods for suspending articles inside the explosive cavities of munitions.

While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a mounting device for inserting and mounting an article inside a cavity of a munition is provided. The mounting device has an axis running through the center of the mounting device and aligned with the direction of insertion of the mounting device into the munition. The mounting device comprises:

a pedestal for leading the insertion of the mounting device into a cavity of a munition, the pedestal having an outer dimension; and a skeletal frame having a first end and a second end, wherein the first end of the frame is joined to the pedestal, and the frame comprises an outermost portion adjacent the second end of the frame, wherein the outermost portion of the frame has an outer dimension, wherein the outer dimension of the pedestal is less than the outer dimension of the outermost portion of the frame, wherein the skeletal frame defines an opening therein for holding an article inside the outermost portion of the frame.

The present invention may also comprise a munition comprising the embedded mounting device described above.

The present invention may further comprise methods of suspending articles inside of tubular structures. In one embodiment, a method of inserting and mounting an article inside an internal explosive cavity of a munition is provided.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention relates generally to devices and methods for suspending articles inside of tubular structures. In some cases, the present invention relates to embedded mounting devices and methods for precisely suspending an article inside the cavity or cavities of munitions in which explosive material surrounding the article is added and cured in a single pour operation.

Figure 1:
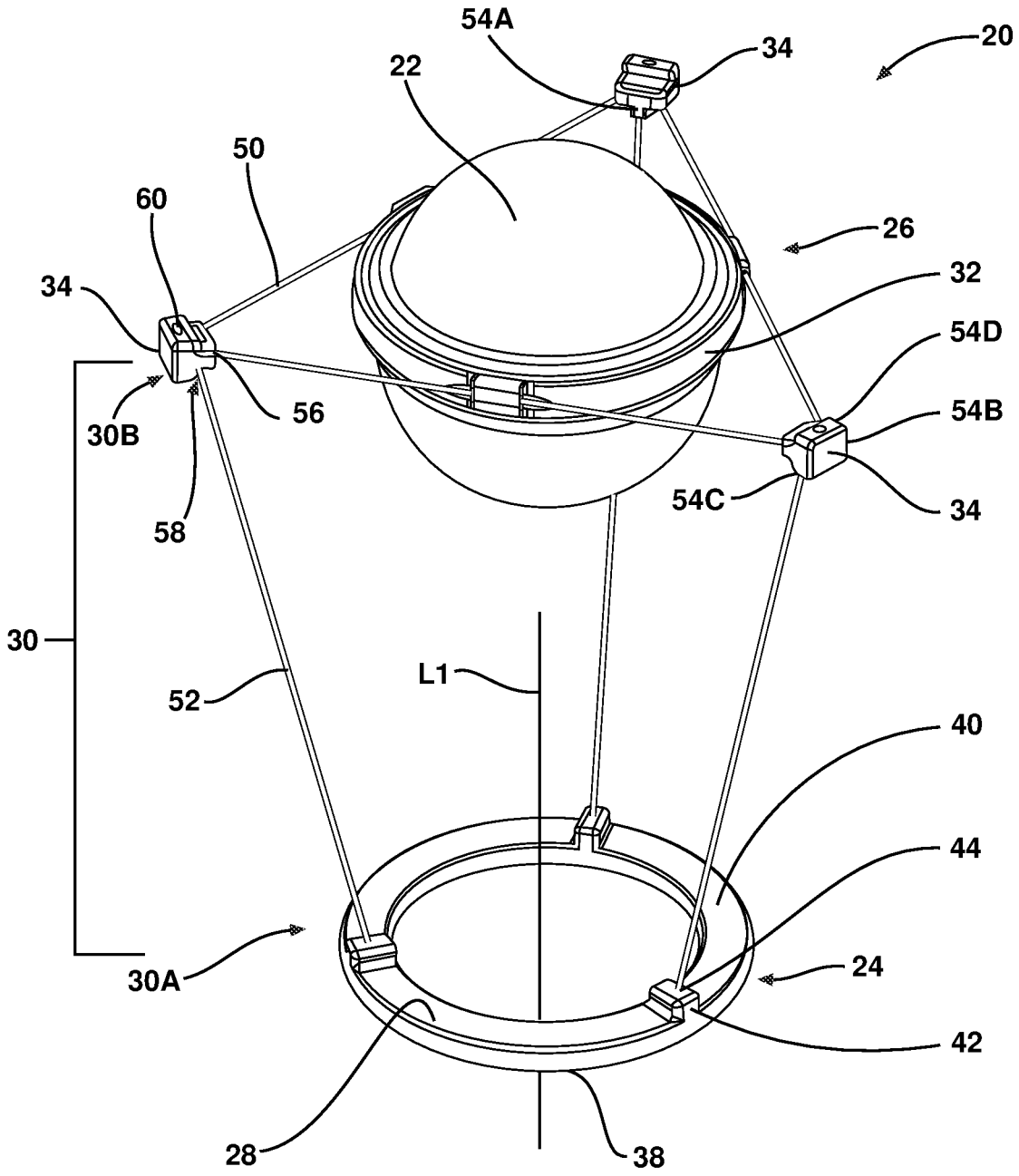
FIG. 1 is a perspective view of one embodiment of a static mounting device which has no dynamically moving parts during installation.
Figure 2:
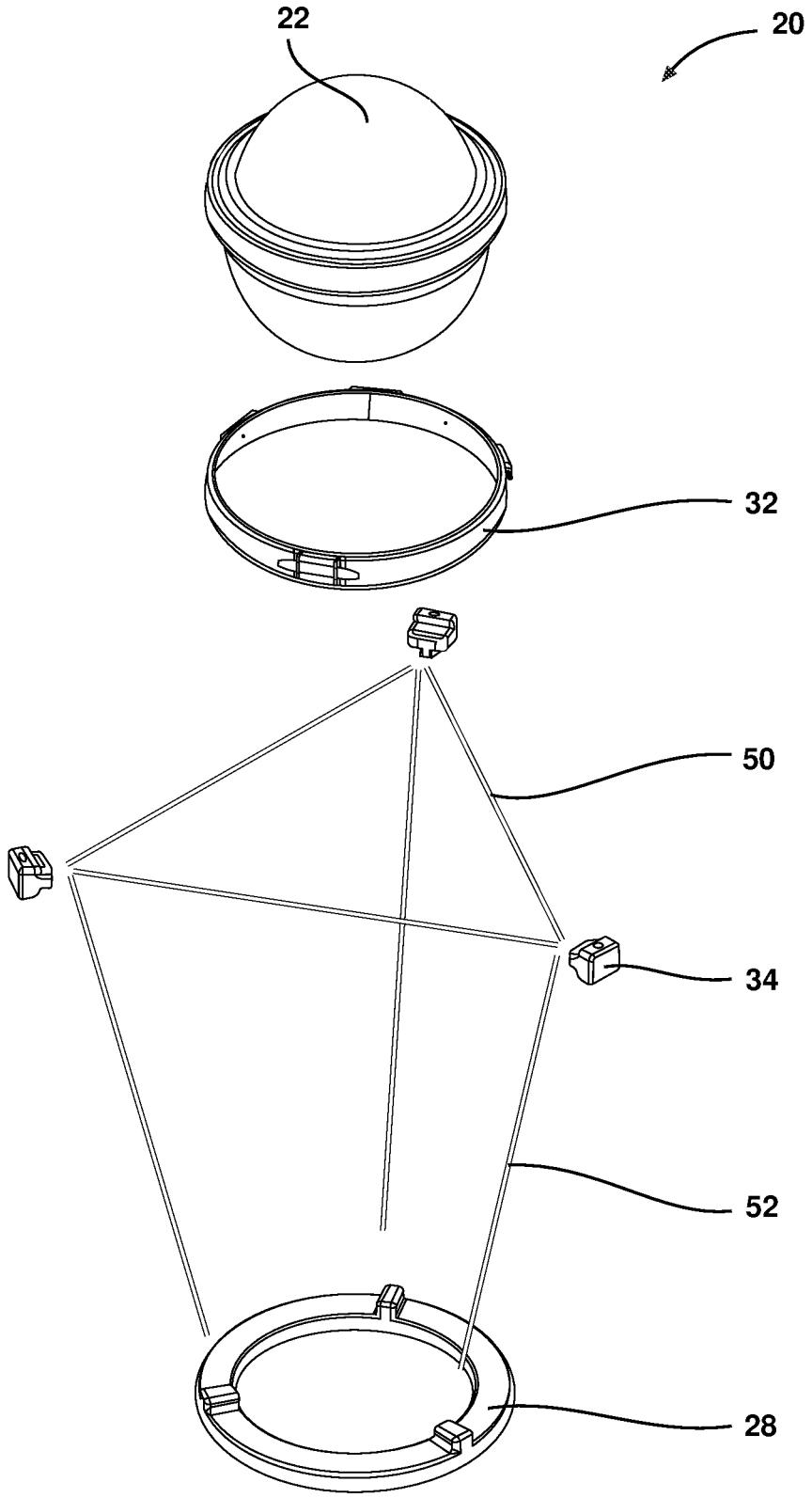
FIG. 2 is an exploded perspective view of the mounting device shown in FIG. 1.

FIGS. 1 and 2 show one non-limiting embodiment of a mounting device 20. The mounting device 20 can be used to suspend any type of article 22 inside any type of cavity. However, the mounting device 20 is particularly useful in suspending articles inside the explosive cavities of munitions. Articles 22 that may be suspended in a munitions cavity include but are not limited to instrumentation packages, data recorders, damage mechanisms, and alternative payloads. Instrumentation packages include, but not limited to one or more of: fuzing components and data recorders. A damage mechanism is a generic term for a device within a munition that is the point source of which causes the damage itself. In one case, the damage mechanism may be a shape charge or a small "bomb" that the mounting device 20 could co-locate inside the cylindrical fill cavity of a munition. The article or articles 22 can have any suitable configuration. The spherical article 22 shown in FIG. 1 generically represents many different types and shapes of articles.

Figure 3:
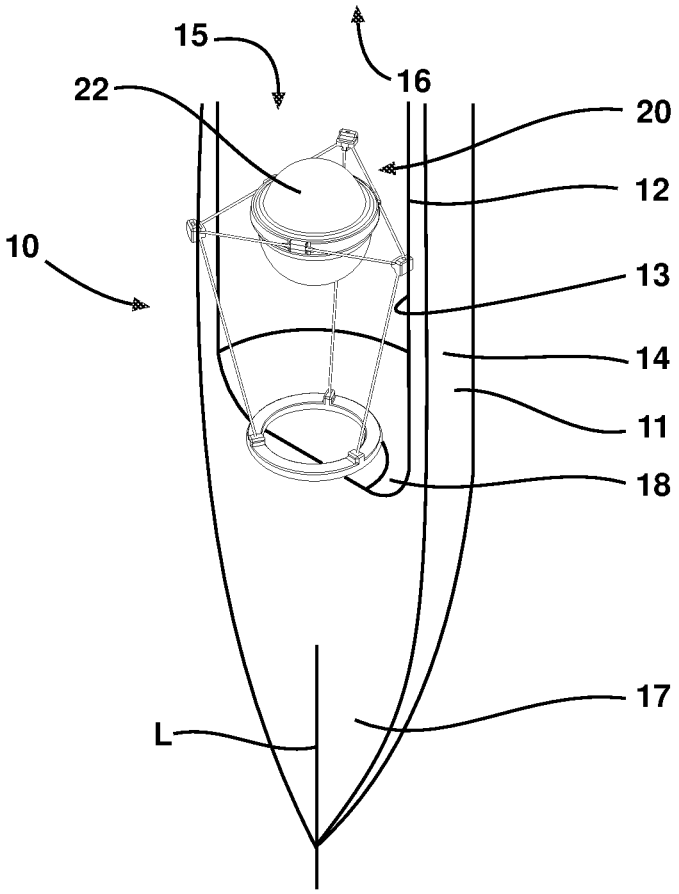
FIG. 3 is a perspective view of the mounting device of FIG. 1 shown inside a sectioned explosive cavity of a munition.
Figure 4:
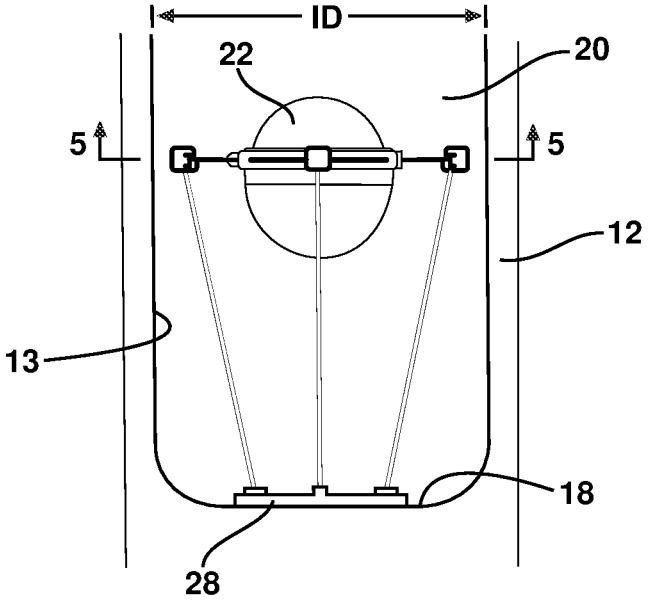
FIG. 4 is a side view of the mounting device shown inside a sectioned explosive cavity of a munition.
Figure 5:
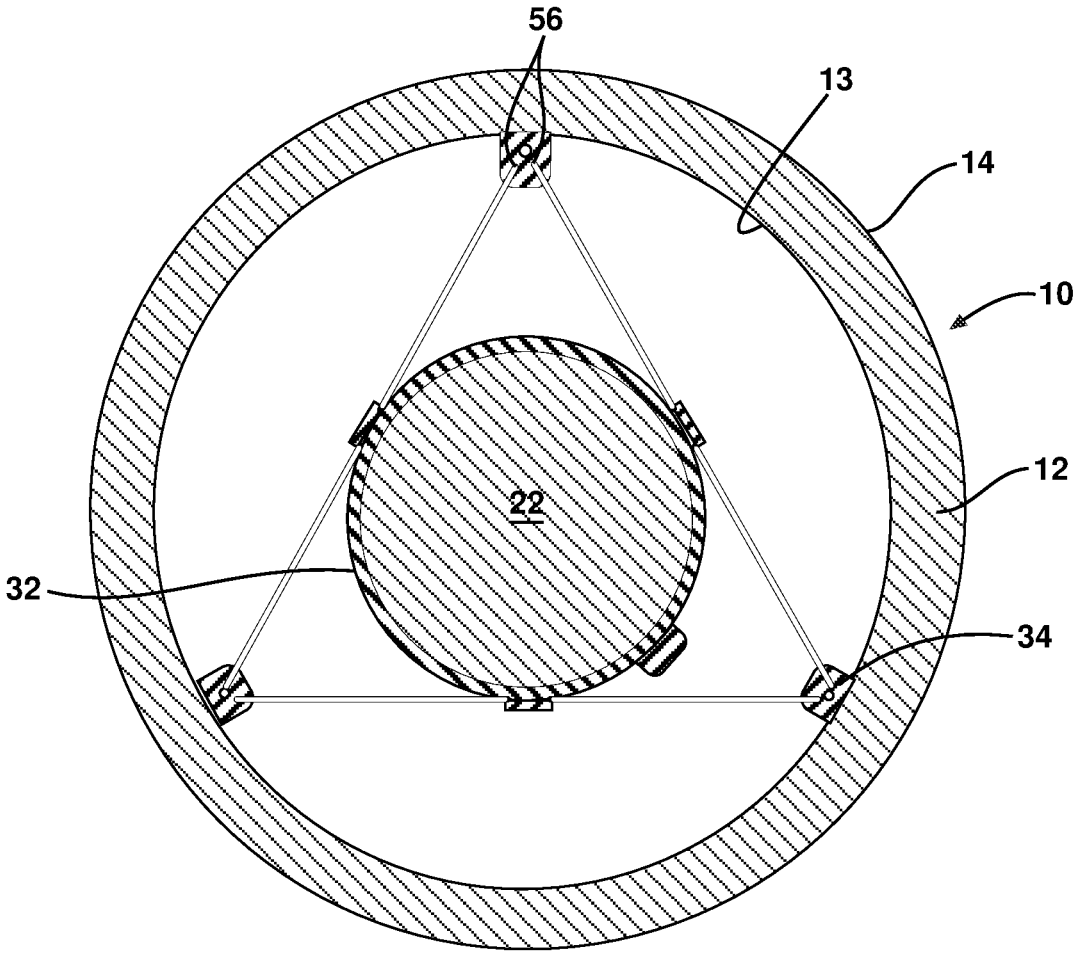
FIG. 5 is cross-sectional view of the mounting device and munition of FIG. 4 taken along line 5-5.

In such cases, it is desirable to suspend such articles in a specific location inside the cavity of a munition prior to filling the cavity with liquid explosives and curing the explosives. FIGS. 3 and 4 show the mounting device 20 and article 22 inside the explosive cavity of a munition 10. The munition 10 comprises a generally tubular housing (or case) 11 having a longitudinal centerline L, a wall 12 having an inside surface 13, an outside surface 14, and a cavity ("explosive cavity") 15 that is defined by the inside surface 13 of the housing and is used for holding explosive material. The munition 10 may have an at least partially open end 16 for filling the explosives, and may taper to a closed front end that forms a nose 17. The munition 10 may further be provided with a forward bulkhead 18, which may be relatively flat. As shown in FIG. 4, the wall 12 of the housing defining the cavity has an inside diameter ID. It should be understood that the sides of the mounting device 20 at the upper portion of the mounting device 20 will typically be in contact with the inside surfaces 13 of the tube as shown in FIG. 5. Often, there is a coating or lining on the inside surface 13 of the wall 12 of the munition. This coating or lining may be relatively rough, and there may be variability in the thickness of this coating at different locations on the inside surface 13 of the munition. When there is such a lining, the sides of the mounting device 20 at the upper portion of the mounting device will be in contact with the surface of the lining.

FIG. 1 shows that the mounting device 20 has a longitudinal axis L1, a first end 24, and a second end 26. The mounting device 20 may have a tapered configuration where the width of the mounting device 20 is greater at the second end 26 than at the first end 24. This is useful because in general weapons decrease in size as they converge in the nose to a closed end. The mounting device 20 may generally comprise an assembly of several components including a pedestal 28 for leading the insertion of the mounting device into the cavity of a munition, and a frame (which may be in the form of a skeletal frame) 30 joined to the pedestal. The pedestal 28 is sized to fit adjacent the flat forward bulkhead 18 while the larger second end 26 of the mounting device 20 is sized to fit the inside diameter of the cavity. The mounting device 20 may further comprise an optional holder 32 for the article 22 such as a removable ring, and optional wall contacts 34. The components of the mounting device 20 can be made of any suitable material(s), provided that the materials are compatible with the explosive used.

The primary function of the pedestal (or nose of the mounting device) 28 is to rest against the closed end of the internal cavity (the bulkhead) 18 to set the zero distance the mounting device 20, and more particularly the article 22, stands off from the forward bulkhead at the closed end. The pedestal 28 has an outer dimension. The outer dimension of the pedestal 28 is less than the outer dimension of the outermost portion of the frame 30. The pedestal 28 may have any suitable configuration. In the embodiments shown in FIGS. 1-4 of the drawings, the pedestal 28 has a generally flat, ring-shaped configuration. In other embodiments, the pedestal may be in the shape of an "X", or in any other suitable shape that provides stability. The pedestal 28 can be made of any suitable material. Suitable materials include, but are not limited to metals and plastics.

The pedestal 28 has an outwardly-facing or outer surface (or "lower surface") 38 and an inner surface (or "upper surface") 40. The lower surface 38 rests against the forward bulkhead 18 of the internal cavity of the munition. The lower surface 38 of the pedestal 28 may have a securing feature joined thereto for securing the pedestal 28 to a surface, such as to the forward bulkhead 18 of the munition. For example, at least a portion of the pedestal 28, or lower surface 38 may be magnetic. The pedestal 28 may also provide connection interfaces or structures for joining the frame 30 thereto (that is, for inserting the ends of the axial rods comprising part of the frame 30). The connection interfaces or structures can be protruding bosses, swivel heads with lockable positions for adjustable pre-loading, or simply drilled holes. In the embodiment shown in FIGS. 1-4, the upper surface of the pedestal 28 has a plurality (e.g., three or four) protuberances (or bosses) 42 thereon. The protuberances 42 may each have an opening 44 in their upper surface sized and configured for receiving the ends of the axial rods of the skeletal frame 30.

The skeletal frame 30 holds and centers the article 22 inside the explosive cavity of the munition 10. The skeletal frame 30 provides enough rigidity to hold the embedded mounting device 20 in place during the filling of the munition but yet does not over-constrain the embedded device and mitigate the advantages of shock isolation from the case that the embedded environment offers. In a traditional munition, there is a fuze that is hard mounted into a cavity in the back end of the munition's base plate closure that caps off the explosive. This is done by clamping the fuze in with a lock-ring that is torqued over the fuze. When a bomb hits a hardened target, the munitions steel structure transfers very high G's through the case and into the fuze in the back. The fuze must survive this impact to properly function in a penetrator post impact. The explosive takes this shock impulse and increases the duration of the event which softens the ride for the embedded device. If the skeletal frame is too rigid, the advantages of the embedded environment may be compromised.

The skeletal frame 30 has a first end 30A and a second end 30B. The first end 30A of the frame 30 is joined to the pedestal 28. The frame 30 comprises an outermost portion adjacent the second end 30B of the frame. The outermost portion of the frame 30 has an outer dimension, wherein the outer dimension of the pedestal 28 is less than the outer dimension of the outermost portion of the frame 30.

The skeletal frame 30 may be made light weight. The skeletal frame 30 may comprise any suitable type of structure. In the embodiment shown in FIGS. 1-5, the skeletal frame 30 comprises a plurality of elongated (or elongate) members. The elongate members may be in the form of rods. The rods may have any suitable cross-sectional configuration including, but not limited to circular. The rods may be solid, or they may be hollow tubes. The elongate members comprise a plurality of laterally-oriented or transversely-oriented (or "transverse") members or rods 50, and a plurality of longitudinal members or longitudinal rods 52. The rods may be relatively thin and flexible. The rods may be flexurally resilient so that after they are bent, they will spring back to their original unbent configuration. The rods may be made of any suitable material(s). Suitable materials include, but are not limited to carbon tubes and a variety of plastic materials. The rods may have any suitable thickness (e.g., diameter) including, but not limited to from about 0.01 inch to about 0.25 inch. In some cases, the rods may have a diameter from about 0.04 inch to about 0.1 inch for solid rods. For example, in some embodiments, the rods may be solid round carbon rods having a diameter of about 0.05 inches or about 0.07 inches. The rods may have a greater diameter in the case of hollow rods and/or if a stiffer rod is desired.

The transverse members 50 comprises a first plurality of members/rods extending outwardly from the housing in a direction substantially perpendicular to the axis of insertion. The transverse members 50 primarily function to concentrically locate and center the article 22 inside the explosive cavity of the munition 10. In the embodiment shown, the transverse members 50 will center the removable ring 32 inside the circular pattern of the wall contacts 34. There may be any suitable number of transverse members or rods 50. In the embodiment shown in FIGS. 1-5, there are three transverse rods 50. The transverse rods 50 may be arranged in any suitable configuration. In the embodiment shown in FIGS. 1-5, the transverse rods 50 are arranged in a triangular configuration that lies in a plane perpendicular to the longitudinal axis L1 of the mounting device 20. The triangular shape formed by the rods surrounds and provides an internal space for the article 22 and any holder 32 for the article to fit therein. As shown in FIGS. 1-4, a portion of the article 22 may protrude outwardly (e.g., upwardly) from the second end 26 of the mounting device 20.

The longitudinal members 52 comprise a second plurality of members/rods extending from the first plurality of rods to the pedestal 28. The longitudinal members 52 primarily function to space the article 22 away from the bulkhead 18. The longitudinal members 52 may have any of the properties described above for the transverse members 50. There may be any suitable number of longitudinal members 52. In the embodiment shown in FIGS. 1-5, there are three longitudinal rods 52. As shown in this embodiment, the longitudinal rods 52 are angled inwardly toward the longitudinal centerline L1 of the mounting device 20 from the second end 26 to the first end 24 thereof.

The primary function of the holder, removable ring, 32 is to aid in the securing the article 22 inside the mounting device 20. The holder 32 is not a portion of the instrumentation package or other article 22, but an element that can be mounted to the article 22. The holder 32 likely will not be stored or shipped with the article 22 to be embedded because it would greatly increase the volume of the explosive transportation/storage container of the article. The holder, removable ring 32, is an optional component of the mounting device 20. In other embodiments, the transverse rods 50 may be joined directly to the article 22 eliminating the need for the holder 32. If a holder 32 is included, the holder is joined to a portion of the frame 30, such as to the transverse members 50. The holder 32 may, but need not, be removable from the frame 30.

There are significant advantages of providing this assembly (mounting device 22 and holder 32) in a configuration that is able to be quickly added to and/or removed from the article 22. This assembly will likely be added late in the stages of buildup and would be joined to (e.g., placed on) an article (such as a fuze) with an explosive detonator so it is a necessity that it can be removed if something is not within specification or needs repair. This is advantageous because, until the mounting device 20 and article 22 are placed in contact with an explosive, the mounting device 20 and the article 22 (if not an explosive) can be assembled by a non-certified explosive handler. Then, when the mounting device 20 and article 22 are placed in contact with an explosive (or if the article 22 comprises an explosive), a certified explosive handler is required. The mounting device 22 and holder 32 can also be assembled and ready to go without having the article 22 in hand. When it is time to fill the munition with explosive material, the explosive handler can take the mounting device 20 and holder 32, and quickly attach it to article 22 and insert the mounting device 20 and article 22 into the explosive cavity. If it did not have this quick attach feature, the explosive handler would have to take time to assemble the mounting device 20 (which may contain small parts) and join it to the article 22 which is not ideal for an explosive munitions assembly line.

The wall contacts 34 function to make contact with the inside surface 13 of the wall forming the cylindrical cavity to enable the mounting device 20 and article 22 to be held concentrically within the cavity 15. The wall contacts 34 may comprise separate components that are joined to the upper portion 30B of the frame 30. In other embodiments, the wall contacts can be integral parts of the elongated member that are located at one or both ends of at least some of the elongated members. The wall contacts 34 may have any suitable configuration. In the embodiment shown in FIGS. 1-5, the wall contacts 34 comprise small blocks having an inwardly-oriented surface 54A and an outwardly-oriented surface 54B. The inwardly-oriented surface 54A may have a plurality of holes (e.g. two) 56 therein for receiving the ends of two axial members 50. The outwardly-oriented surface 54B may be configured to fit closely against inside surface of the cavity of the munition. The wall contacts 34 shown in FIGS. 1-5 also have a lower surface 54C and an upper surface 54D. The lower surface 54C has a hole 58 therein for receiving the end of a longitudinal member 52.

In some embodiments, the upper surfaces 54D of the wall contacts 34 may also have a hole 60 therein. There are situations where multiple articles 22 may need to be embedded into the cavity of a munition (such as when multiple fuses will be used). The holes 60 in the upper surfaces 54D of the wall contacts 34 may provide structures for inserting the ends of the additional longitudinal members to provide multiple stacked mounting devices 20 or variations thereof (as further described below) to allow for multiple articles 22 to be added in a single filling operation.

FIGS. 6-12C shows a second non-limiting embodiment of the mounting device 20. This embodiment may be referred to as a dynamic mounting device because the skeletal frame 30 is collapsible and expandable. This embodiment may be used in situations where the internal cavity of the munition may have obstructions preventing a static mounting device such as that shown in FIGS. 1-5 to pass and to be positioned correctly. The mounting device 20 shown in FIGS. 6-12C allows the mounting device 20 to be used in multiple legacy weapons that pose obstructions inside the weapon's internal cavity.

Figure 6:
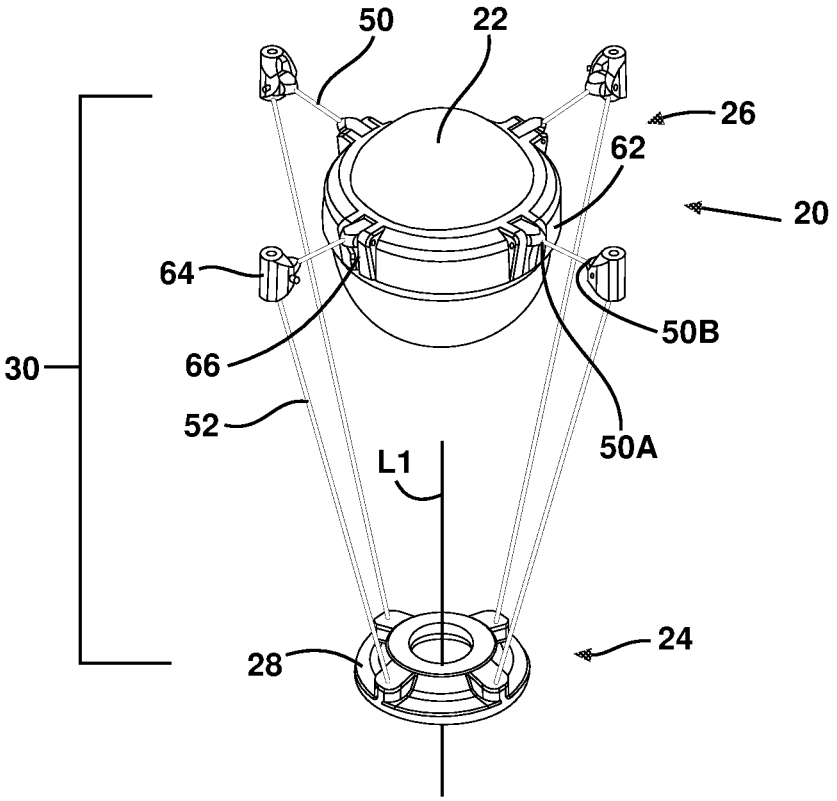
FIG. 6 is a perspective view of another embodiment of a mounting device that has dynamically moving parts that can be physically manipulated, which embodiment is shown in the deployed state.

The dynamic mounting device 20 comprises many of the same elements as the static mounting device shown in FIGS. 1-5. FIG. 6 shows that this embodiment of the mounting device 20 also comprises a pedestal 28 for leading the insertion of the mounting device into a cavity of a munition, and a frame (which may be in the form of a skeletal frame) 30 joined to the pedestal. The mounting device 20 has a first end 24 and a second end 26, and a tapered configuration where the width of the mounting device 20 is greater at the second end 26 than at the first end 24. The elements of the dynamic mounting device 20 may be considered to be the same as those of the static mounting device unless described otherwise herein.

The frame 30 of the embodiment shown in FIG. 6 differs from the static mounting device in that rather than being static and fixed in its configuration, it is collapsible and expandable so that the mounting device 20 can move past obstructions in the munition cavity. The ability to collapse and expand is achieved by providing portions of the frame 30 with the ability to pivot and fold. The frame 30 of the dynamic mounting device 20 also comprises a plurality of members or rods, each having a proximal end and a distal end. The members also comprise transverse members 50 and longitudinal members 52. There can be any suitable number of transverse members 50, and the transverse members can be in any suitable form.

In the embodiment shown in FIGS. 6-12C, there are four transverse rods 50. The transverse rods 50 may have any suitable length. In the embodiment shown, the transverse rods 50 may have a length that is less than half the length of the longitudinal members 52. The orientation of the transverse rods 50 also differs in that the transverse rods extend 50 radially in a direction outward from the axis L1 running through the center of the mounting device 20 that is aligned with the direction of insertion of the mounting device into the munition. The transverse rods 50 in this embodiment may, therefore, be referred to as "radial members" or "radial rods". The radial rods 50 have proximal ends 50A and distal ends 50B.

The proximal ends 50A of the radial rods 50 are positioned adjacent to the article 22 that is held by the mounting device 20. The proximal ends 50A of the radial rods can be joined directly to the article 22; or, they may be joined to a holder such as a removable ring 62 that aids in the securing the article 22 inside the mounting device 20 assembly.

Figure 8:
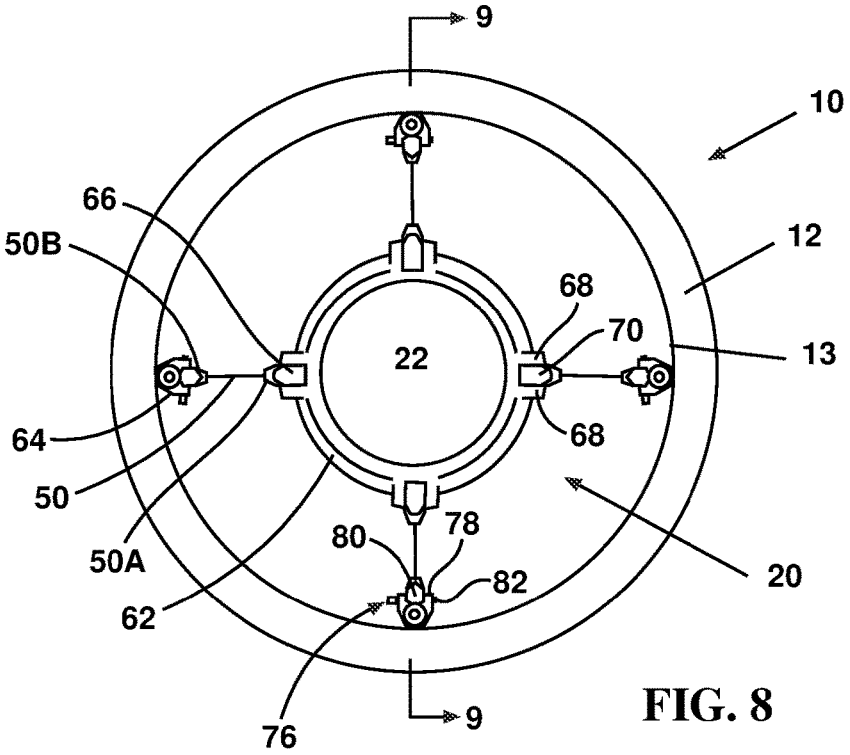
FIG. 8 is a top view of the mounting device in FIG. 6 shown inside the explosive cavity of a munition.
Figure 9:
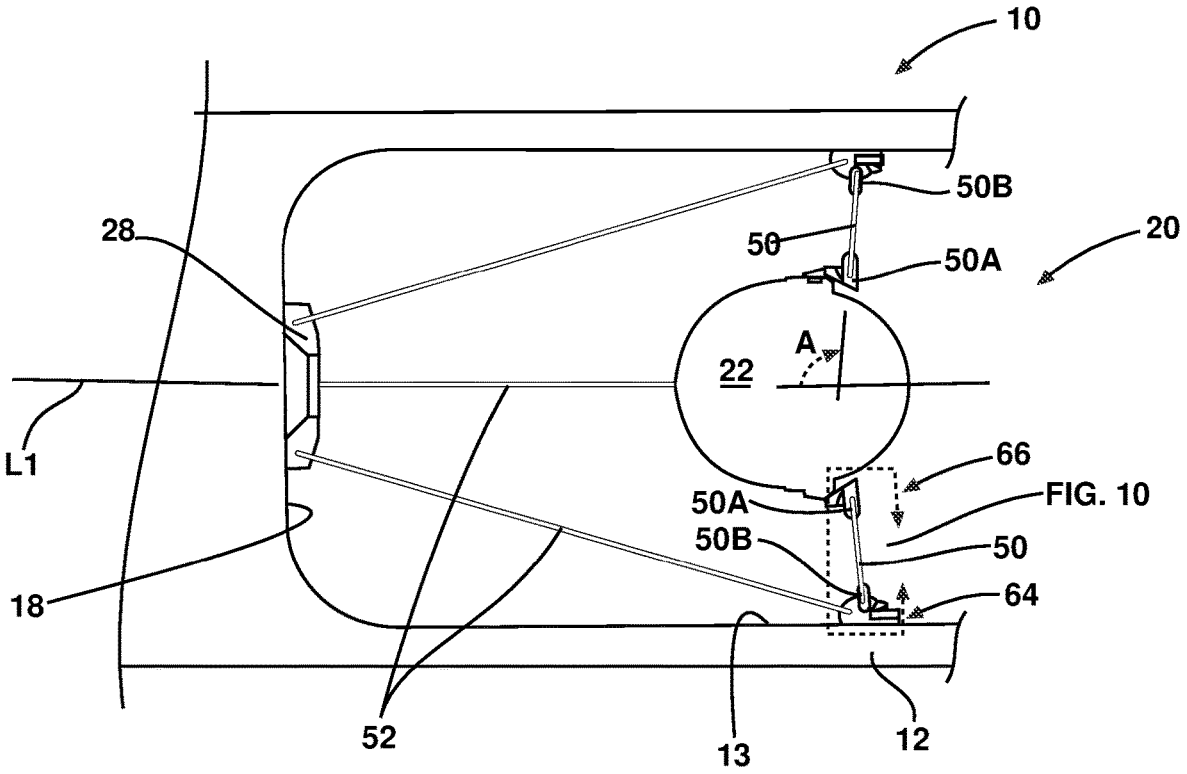
FIG. 9 is a cross-sectional view of the mounting device and munition of FIG. 8 taken along line 9-9.
Figure 10:
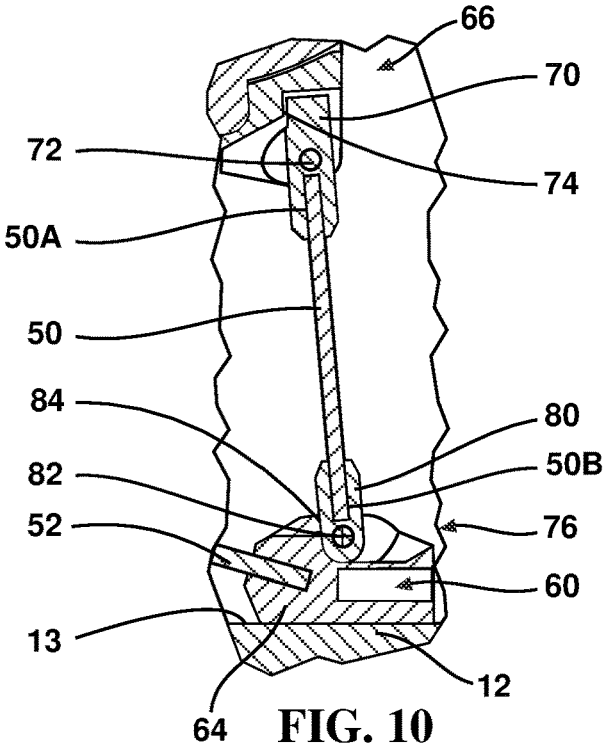
FIG. 10 is a detailed view of the dynamic components highlighted in FIG. 8.
Figure 11:
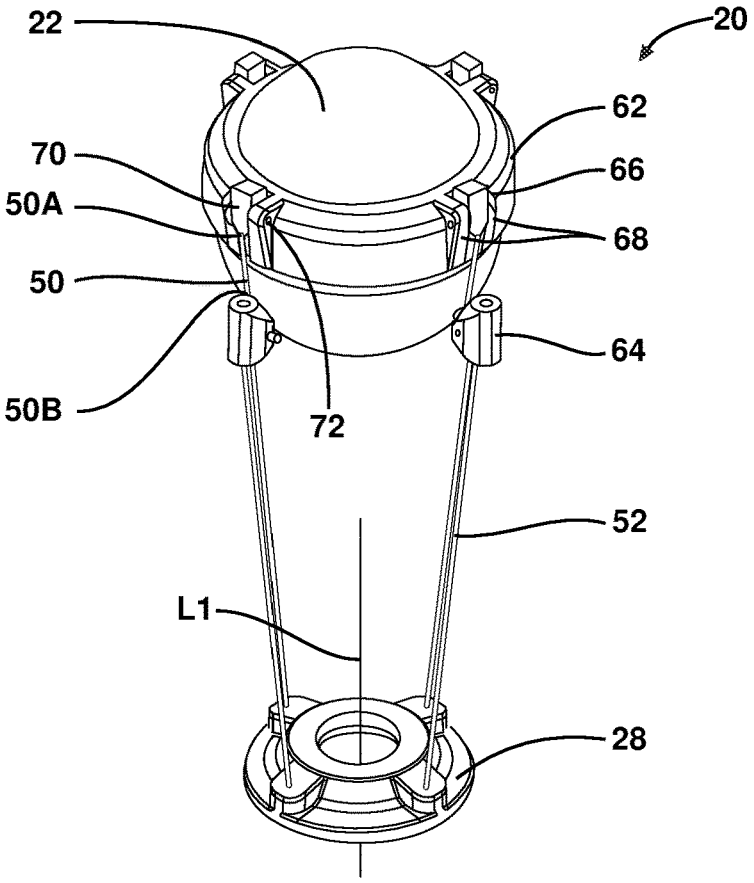
FIG. 11 is a perspective view of the embodied mounting device in FIG. 6 in the stowed position.

The proximal ends 50A of the radial rods 50 are joined to the article or holder 62 at pivotable connections, such as by pivotable connectors (or "inner pivotable connectors") 66. As shown in FIGS. 8 and 11, the pivotable connectors 66 each comprise a pair of spaced apart flanges or projections 68 that define a gap therebetween, a pivotable holder 70 for the proximal end 50A of the radial rod 50. The pivotable holder 70 has one end thereof positioned in the gap between the projections 68. The pivotable holder 70 is pivotably joined to the projections 68 by a pin 72 that passes through a hole in the pivotable holder 70. The pivotable connectors 66 may further be provided with a rotation limiter, such as in the form of a shelf 74 (shown in FIG. 10) so that the distal ends 50B of the radial rods 50 are prevented from rotating beyond the desired position. The desired position is shown in FIG. 9 and is designated by the angle A that the radial rods 50 make relative to the longitudinal axis L1 of the mounting device 20. The angle A depends on the internal diameter of the munition case. The angle A is typically greater than 90°. In some cases, the angle A may range from greater than 90° to about 95°, or from about 92° to about 95°.

The distal ends 50B of the radial rods are joined to hinged wall contacts 64. These hinged wall 64 contacts perform a similar function to the wall contacts described in the embodiment shown in FIGS. 1-5, but additionally serve to allow the radial rods 50 pivot between a stowed position and a deployed position. The hinged wall contacts 64 differ from the wall contacts of the previous embodiment in that they comprise outer pivotable connectors 76 (FIG. 8). These pivotable connectors 76 may be similar to the inner pivotable connectors at the proximal ends 50A of the radial rods 50. As shown in FIGS. 8 and 10, the outer pivotable connectors 76 each comprise a pair of spaced apart flanges or projections 78 that define a gap therebetween, a pivotable holder 80 for the distal end 50B of the radial rod 50. The pivotable holder 80 has one end thereof positioned in the gap between the projections 78. The pivotable holder 80 is pivotably joined to the projections 78 by a pin 82 that passes through a hole in the pivotable holder 80. The outer pivotable connectors 76 may further be provided with a rotation limiter, such as in the form of a shelf 84 (shown in FIG. 10) so that the distal ends 50B of the radial rods 50 are prevented from rotating beyond the desired position. These limiters provide a stop to prevent the radial rods 50 from swinging too far past center and collapsing the skeletal frame 30 in the opposite direction to that shown FIG. 11 (that is, collapsing the skeletal frame 30 in a direction where the hinged wall contacts 64 would be positioned above the article 22 in FIG. 11).

Figure 7:
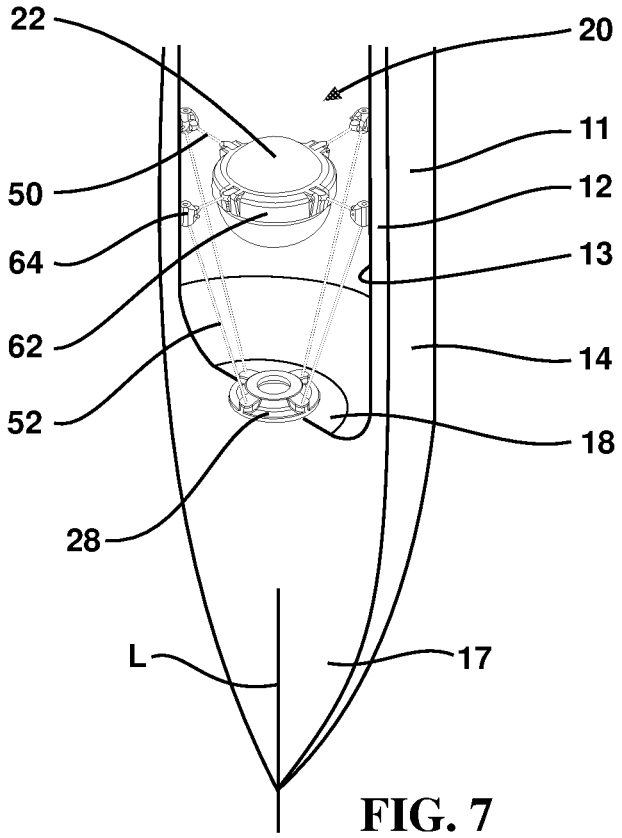
FIG. 7 is a perspective view of the mounting device of FIG. 6 shown inside a sectioned explosive cavity of a munition.
Figure 12A:
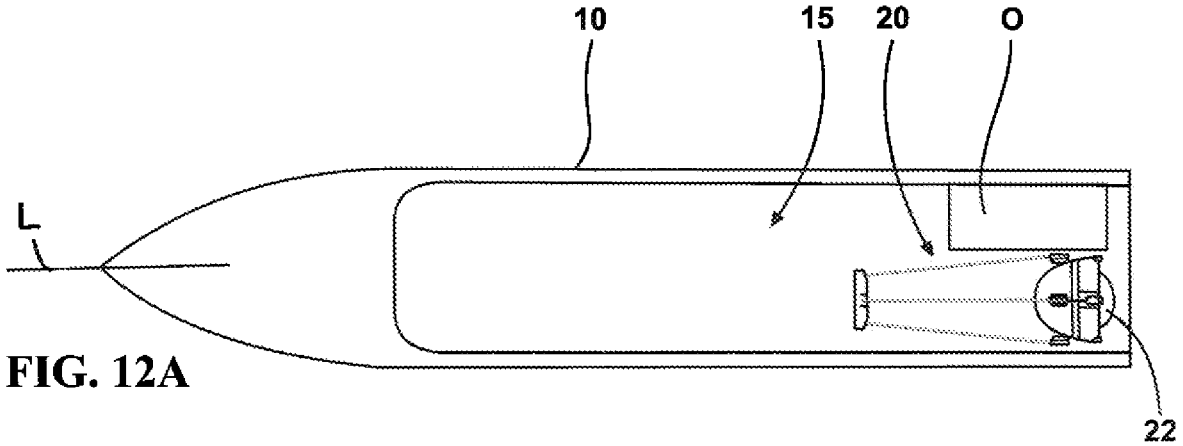
FIG. 12A is a schematic side view of the initial stage of inserting a mounting device similar to that shown in FIG. 6 into the explosive cavity of a munition having an obstruction inside thereof, where the mounting device is in the stowed position.

FIGS. 11 and 12A show the dynamic mounting device 20 in a stowed position. In the stowed position, the radial rods 50 are pivoted or rotated so that their proximal ends 50A are moved further away from the pedestal 28 and their distal ends 50B are moved toward the axis L1 of the mounting device 20. FIGS. 7 and 9 show the dynamic mounting device 20 in a deployed position. In the deployed position, the radial rods 50 are pivoted or rotated so that their proximal ends 50A are moved toward the pedestal 28 and their distal ends 50B are moved away from the axis L1 of the mounting device 20 and are oriented transversely so that the hinged wall contacts 64 can contact the inside surface 13 of the wall forming the cylindrical cavity of the munition 10.

Figure 12B:
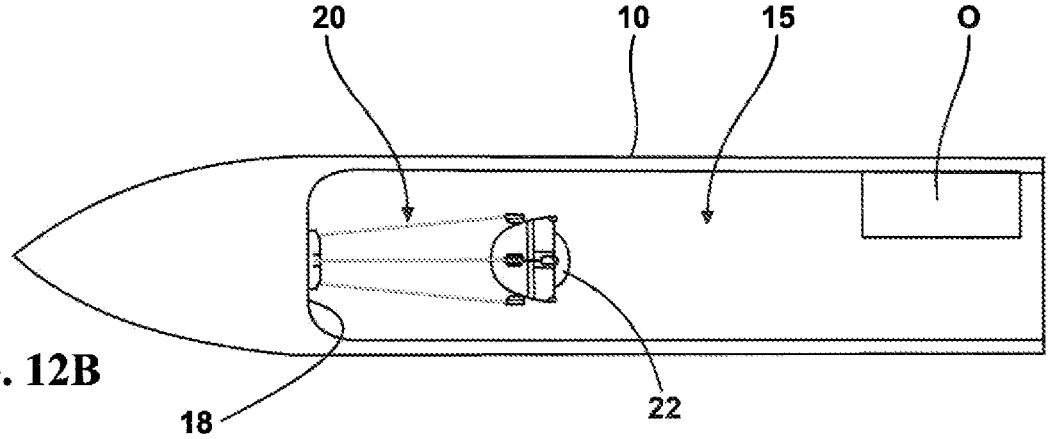
FIG. 12B is a schematic side view of the second phase of inserting a mounting device similar to that shown in FIG. 6 into the explosive cavity of a munition where the mounting device is in the stowed position and in contact with the forward bulkhead of the munition.
Figure 12C:
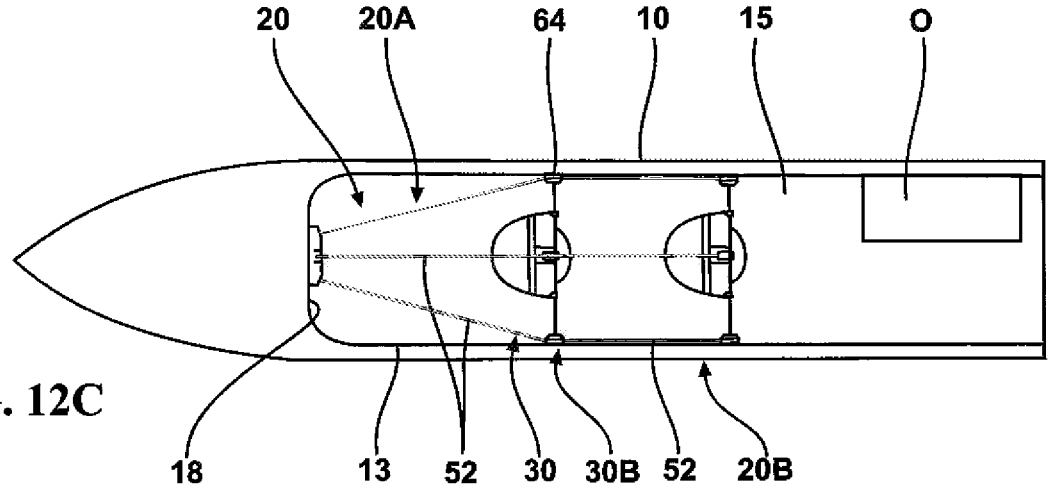
FIG. 12C is a schematic side view of the third phase of inserting a mounting device similar to that shown in FIG. 6 into the explosive cavity of a munition where the mounting device is in the fully deployed state in contact with the forward bulkhead of the munition, and a second mounting device is joined thereto.

FIGS. 12A to 12C show the stages of inserting a mounting device 20 similar to that shown in FIG. 6 into the explosive cavity of a munition having an obstruction, O, inside thereof. Although the munition 10 is shown in FIGS. 12A to 12C with its longitudinal centerline L oriented horizontally in the drawings, it should be understood that the munitions 10 will typically have their noses pointed downward and be oriented so that their longitudinal centerlines will be vertical during the process illustrated. FIG. 12A shows the initial stage of inserting the mounting device 20 into the explosive cavity 15 of a munition 10 having an obstruction, O, inside thereof. As shown in FIG. 12A, the dynamic variation of the mounting device 20 is in its stowed position as it is guided past the obstruction, O. FIG. 12B shows the second phase of inserting the mounting device 20 into the explosive cavity of the munition. In FIG. 12B the mounting device 20 makes contact with the closed end 18 of the cavity and with a forward motion, the device 20 expands and locks into position shown in FIG. 12C. In the fully expanded position, the inner walls 13 of the munition 10 hold the mounting device 20 in place from the expanding force from the skeletal frame 30 going beyond its desired over center orientation described in further detail below. FIG. 12C also shows the stacking of an additional mounting device 20B on the first mounting device 20A, which is also described in detail below.

Figure 13:
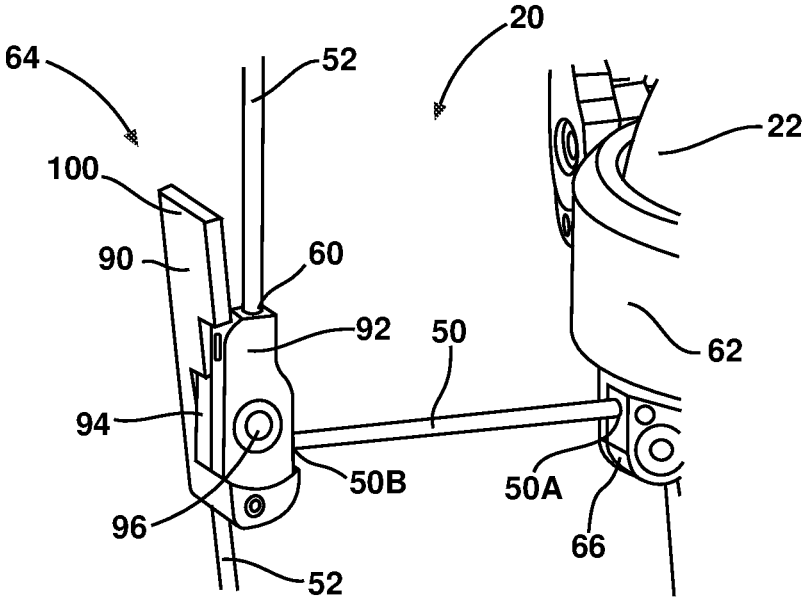
FIG. 13 is an enlarged perspective view of a portion of an alternative embodiment of a dynamic mounting device that has multi-component hinged wall contacts.

FIG. 13 shows an alternative embodiment of a dynamic mounting device 20 in which the configuration of the hinged wall contacts 64 differs from those of the previous dynamic mounting device. The hinged wall contacts 64 in this embodiment are each comprised of multiple components. These include wall-contacting components 90 that may be referred to as "paddles". The longitudinal members 52 are joined to the paddles 90 such as by inserting them into a hole in the bottom surface of the paddles 90. The paddles 90 can be pivotably joined to stacking members 92. The stacking members 92 may have a hole 60 in the upper surface thereof for inserting the ends of additional longitudinal members therein in order to provide multiple stacked mounting devices 20. The paddles 90 are pivotable about a pivotable joint 96 so that a portion of each paddle (which may be referred to as the "leading edge" 100 of the paddle) is in contact with the lining on the inside surface 13 of the wall 12 of the munition. The multiple component arrangement allows the paddles 90 to rotate independently relative to the radial rods 50. This provides the mounting device 20 with greater adjustability to maintain the paddles 90 in contact with the inside surface 13 of the munition and any lining thereon, particularly when there is variability in the thickness of such a lining. The orientation of the paddles 90 (that is, the amount of rotation of the paddles) is the result of any bending forces acting on the longitudinal members 52.

Figure 14A:
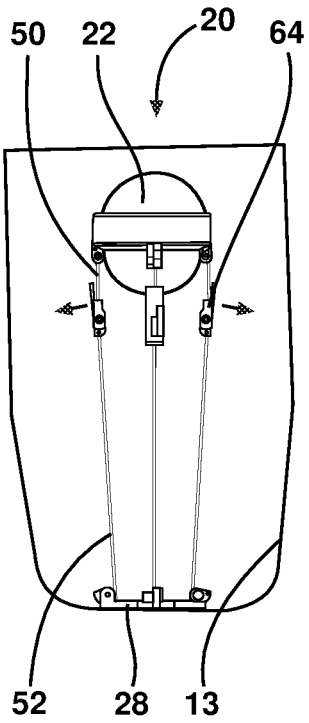
FIG. 14A is a schematic side view of the first configuration that a mounting device having multi-component hinged wall contacts shown in FIG. 13 will take when inserted into the explosive cavity of a munition where the mounting device is in the stowed position and in contact with the forward bulkhead of the munition.
Figure 14B:
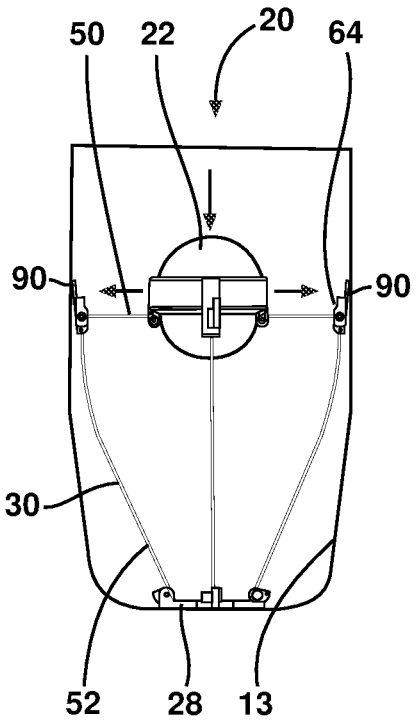
FIG. 14B is a schematic side view of the second ("on center") configuration that the dynamic mounting device shown in FIG. 14A will take when inserted into the explosive cavity of a munition when the mounting device is in contact with the forward bulkhead of the munition and the article that is being held by the mounting device is pushed downward.
Figure 14C:
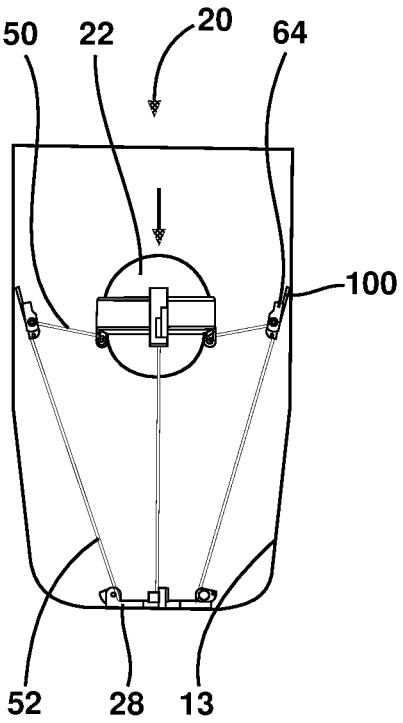
FIG. 14C is a schematic side view of the third ("over center") configuration that a mounting device shown in FIG. 14A will take when inserted into the explosive cavity of a munition when the mounting device is in contact with the forward bulkhead of the munition, and the article that is being held by the mounting device is pushed further downward into a stable position.

FIGS. 14A-14C show the expansion that the mounting device 20 may undergo when the mounting device 20 is inserted into the explosive cavity of a munition, and when the pedestal 28 is in contact with the forward bulkhead 18 of the munition.

FIG. 14A shows the mounting device 20 in the stowed position when the pedestal 28 first makes contact with the bulkhead 18. In this configuration, the radial rods 50 extend downward and the wall contacts 64 are still in the stowed position that allowed the mounting device 20 to navigate through potential obstructions. In this position, the mounting device 20 is in its minimum diameter configuration. Pushing the mounting device 20 against the bulkhead 18 will tend to open the frame in the direction of the arrows.

FIG. 14B shows a second configuration that the mounting device 20 will take when the article 22 being held by the mounting device is pushed downward. This is referred to as the "on center" position. As article 22 is pushed down in the direction of the pedestal 28, the radial rods 50 will expand out until they are "on center" where the radial rods 50 and the wall contacts 64 are at the maximum radial expansion (90° outward) from the longitudinal centerline L1. It may be desirable, however, for the frame 30 to be dimensioned so that the maximum radial expansion of the radial rods 50 will cause the distance between the leading edges 100 of opposing wall contacts 64 to be greater than the ID of the cavity. That is, the frame 30 is wider than the ID of the cavity when the mounting device 20 is outside the cavity and is, thus, not constrained by the walls of the cavity. In order to accommodate this radial expansion, the wall contacts are rotated to align toward the axial direction of the munitions cavity by the outward expansion of radial rods 50 causing the longitudinal rods 52 to deflect as shown in FIG. 13B into a single or double bending mode. In this position, the paddles 90 may be nearly flush with the inside surface 13 of the munition. In this position, the frame 30 is over-constrained and unstable and will not remain in this position and will require additional pushing downward on the article 22 to stabilize the mounting device 20. In FIG. 14B, the longitudinal rods 52 may be bowed generally outward in a single or double bend configuration. A double bend configuration is one in which a portion of the longitudinal rods 52 near the pedestal 28 is bent slightly inward and other portions of the longitudinal rods 52 are bowed generally outward.

FIG. 14C shows that as the article 22 is pushed past the "on center" position, the radial expansion decreases. This allows the spring-loading of the rods 52 to relieve a portion of the forced deflection to move the leading edges 100 of the wall contacts 64 outwards keeping contact with the inside wall of the cavity. This creates a soft maximum diameter of the frame 30. This position is referred to as "over center". The mounting device 20 will tend to want to stay in this over center position to keep the mounting device 20 holding article 22 snuggly in place for the filling operation. Gravity may cause some deflection or sagging on the mounting device 20 and article 22 when they are inserted downward into the munition case. Once filled, embedded objects such as article 22, become neutrally buoyant, allowing the radial rods 50 to fully spring back into position to counter any deflection or sagging that may have occurred due to the effect of gravity on the mounting device 20 and article 22 when inserted downward into the munition case.

The present invention also relates to a munition 10 comprising an embedded mounting device 20 described herein. The munition 10 may comprise: a munition case 11 having longitudinal centerline L, an internal cavity 15 with an inside diameter; and a mounting device 20 positioned inside the internal cavity of the munition case. The mounting device comprises: a pedestal 28 for leading the insertion of the mounting device 20 into the internal explosive cavity 15 of the munition case; and a skeletal frame 30. The skeletal frame 30 has a first end 30A and a second end 30B. The first end is joined to the pedestal. The frame comprises an outermost portion adjacent the second end of the frame, and the outermost portion of the frame 30 has an outer dimension. The outer dimension of the pedestal 28 is less than the outer dimension of the outermost portion of the frame. The skeletal frame 30 defines an opening therein for holding an article inside the outermost portion of the frame. The munition 10 further comprises an article 22 positioned inside the outermost portion of the skeletal frame 30.

The present invention also relates to methods of suspending articles inside of tubular structures. In one embodiment, a method of inserting and mounting a portion of an article inside an internal explosive cavity of a munition is provided. The method may comprise the steps of:

(a) providing a munition case having longitudinal centerline, an internal cavity with an inside diameter;

(b) providing a mounting device comprising:

a pedestal for leading the insertion of the mounting device into an internal explosive cavity of a munition; and a skeletal frame having a first end and a second end, wherein the first end is joined to the pedestal, wherein the frame comprises an outermost portion adjacent the second end of the frame, and wherein the outermost portion of the frame has an outer dimension, wherein the outer dimension of the pedestal is less than the outer dimension of the outermost portion of the frame, wherein the skeletal frame defines an opening therein for holding an article inside the outermost portion of the frame;

(c) positioning an article in the opening defined by the skeletal frame of the mounting device;

(d) inserting the mounting device and article into the internal cavity of the munitions case by inserting the pedestal first, wherein the outermost portion of the frame of mounting device centers the article in the internal cavity of the munition; and (e) pouring a liquid explosive material into the internal cavity of the munition case.

In some variations of the method, the case may have an obstruction O on its inside surface, and the skeletal frame 30 folds so that the mounting device 20 can be inserted past the obstruction.

In some variations of the present invention as shown in FIG. 12C, there can be two or more mounting devices (or portions thereof) positioned inside a tubular structure. In such case, the mounting device 20 described above may comprise a first mounting device that may be designated with reference number 20A. The second, third, etc. mounting devices can be designated with reference numbers 20B, etc. In some cases, the second mounting device 20B may have the same components as the first mounting device 20A, including the pedestal 28. In other cases, as shown in FIG. 12C, the second mounting device 20B may be a modified version of the first mounting device 20A which does not comprise a pedestal. Such a device may be referred to as a "stacking device". In such a case, the second mounting device (stacking device) 20B may be joined to portions of the skeletal frame 30 of the first mounting device 20A at the second end 30B thereof. Specifically, the distal ends of the longitudinal rods 52 of the stacking device 20B are inserted into holes 60 in the top of the wall contacts, or hinged wall contacts 64, of the first mounting device. The first mounting device 20A can be inserted into the cavity of the munition first, and then the stacking device 20B can be inserted and joined to the first mounting device. However, in order to avoid issues with aligning the distal ends of the longitudinal rods 52 of the stacking device 20B with the holes 60 in the top of the hinged wall contacts 64 of the first mounting device 20A, and to move the stacking device 20B past an obstruction, it may be desirable for the stacking device 20B to first be joined to the first mounting device 20A, and the assembled structure to be inserted into the cavity of the munition as a single expandable unit.

The embodiment of the mounting device 20 selected for use is determined by the internal cavity of the weapon and the article 22 which will be embedded inside the fill. In some cases, it may be desirable to avoid having direct load paths into the embedded item in order to isolate it from the structural case. The mounting devices described herein can serve this purpose. It can be a static frame that is placed down into a cavity as shown in FIGS. 1-5; or an expandable structure shown in FIG. 6 to FIG. 15 that can squeeze through small openings and then expanded out to lock into place.

The mounting device 20 is loaded from whichever side of the munition has easier access to the internal cavity and is held into position by either gravity or friction against the inner walls of the case. The device is guided down the internal cavity of a munition and is released in position. If gravity is the key force keeping the device 20 in position, the munition is placed upright with its nose downward, and the device is released at the bottom. A device such as magnet on the pedestal can aid in holding the device 20 in position if the material of the bulkhead is ferromagnetic, or an interference fit may be placed on the outer diameter of a static assembly to secure the device in place.

The embedded mounting devices and methods described herein can provide a number of advantages. It should be understood, however, that these advantages need not be required unless they are set forth in the appended claims. The embedded mounting devices and methods provide a light weight skeleton to position items inside a tubular structure. In the case of munitions, the articles may be embedded in an internal explosive cavity in which the explosive is then poured in and cured to hold the article in position for the life of the weapon. The embedded mounting devices enable munitions with embedded devices such as a firesets or data recorders to be filled within a single fill operation saving time and money over current methods that require multi-pour operations. The advantages are cost/time savings to enable current filling operations to be compatible with the embedded articles. The methods do not necessitate a complex retooling of the labor intensive procedures that are required in current embedded filling operations.

There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention. Any of the embodiments described herein can also be combined with any other embodiments in any manner to form still other embodiments.

The term "joined", as used herein, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined" includes both those configurations in which an element is temporarily joined to another element, or in which an element is permanently joined to another element.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A mounting device for inserting and mounting an article inside a cavity within a housing of a munition, said mounting device having a longitudinal axis running through the center of the mounting device and aligned with the direction of insertion of the mounting device into the munition, said mounting device comprising:

a pedestal for leading the insertion of the mounting device into a cavity of a munition, said pedestal having an outer dimension, said pedestal having an outwardly-facing surface and an inner surface; and a skeletal frame having a first end and a second end, wherein the first end of said skeletal frame is joined to said pedestal, and said skeletal frame comprises an outermost portion adjacent said second end of said skeletal frame, and wherein said outermost portion of said skeletal frame has an outer dimension, wherein the outer dimension of said pedestal is less than the outer dimension of said outermost portion of said skeletal frame, wherein said skeletal frame comprises a plurality of transverse members and a plurality of longitudinal members, wherein the transverse members are located at the second end of the skeletal frame and have an orientation in which they are oriented substantially perpendicular to the longitudinal axis of the mounting device, and the longitudinal members each have a first end that is joined to the pedestal and a second end that is joined to at least one of the transverse members at the second end of the skeletal frame at a location that is adjacent the outermost portion of said skeletal frame, wherein said skeletal frame defines an opening therein along the longitudinal axis between the transverse members for holding at least a portion of an article inside the outermost portion of said frame.

2. The mounting device of claim 1 wherein the plurality of transverse members comprises three transverse members that are arranged in a triangular configuration, wherein each transverse member has two ends, and the plurality of longitudinal members comprises three longitudinal members, wherein the second end of each of the longitudinal members is joined to the ends of two of the transverse members.

3. The mounting device of claim 1 wherein the plurality of transverse members comprises four transverse members that each have a proximal end and a distal end, and said transverse members are spaced apart and extend radially in a direction outward from the longitudinal axis from their proximal ends to their distal ends, and the plurality of longitudinal members comprises four longitudinal members, one of which is joined at its second end to each of the distal ends of the transverse members.

4. The mounting device of claim 3 wherein the transverse members are configured to pivot inwardly toward the longitudinal axis so that the skeletal frame is collapsible.

5. The mounting device of claim 1 wherein the skeletal frame has a fixed configuration under the forces associated with inserting the mounting device into the cavity of a munition.

6. The mounting device of claim 1 wherein the skeletal frame is collapsible and expandable.

7. The mounting device of claim 1 further comprising a holder for an article, wherein said holder is joined to the transverse members at the second end of said skeletal frame.

8. The mounting device of claim 7 wherein said holder comprises a ring.

9. The mounting device of claim 1 wherein the munition has walls that define the sides of the cavity of the munition, and the transverse members each have a pair of ends, and the mounting device further comprises a plurality of wall contacts each of which is joined to one of the ends of at least one of the transverse members and to the second end of one of the longitudinal members at the outermost portion of the second end of the skeletal frame, wherein the skeletal frame is sized and configured so that said wall contacts will engage the walls forming the cavity of a munition or any coating thereon to center an article within the cavity of the munition.

10. The mounting device of claim 1 wherein the munition has a forward bulkhead inside its cavity, and the outwardly-facing surface of the pedestal has a securing feature joined thereto that is configured to secure the pedestal to the forward bulkhead of the munition.

11. A munition comprising:

a munition case having longitudinal centerline, an internal cavity with an inside diameter, and walls that define the sides of the internal cavity of the munition case;

a mounting device positioned inside the internal cavity of said munition case, said mounting device having a longitudinal axis and comprising:

a pedestal for leading the insertion of the mounting device into the internal cavity of the munition case; and a skeletal frame having a first end and a second end, wherein said first end is joined to said pedestal, wherein said frame comprises an outermost portion adjacent said second end of said frame, and wherein said outermost portion of said frame has an outer dimension, wherein the outer dimension of said pedestal is less than the outer dimension of said outermost portion of said frame, wherein said skeletal frame defines an opening therein for holding an article inside said outermost portion of said frame, wherein said skeletal frame comprises a plurality of transverse members and a plurality of longitudinal members, wherein the longitudinal members each have a first end that is joined to the pedestal and a second end that is joined to at least one of the transverse members at the second end of the skeletal frame at a location that is adjacent the outermost portion of said skeletal frame, and wherein the outermost portion of said skeletal frame contacts the sides of the internal cavity of the munition case or any coating on the walls forming the cavity of the munition to suspend and center an article inside the munition case; and an article positioned inside said outermost portion of said skeletal frame.

12. The munition of claim 11 wherein said article comprises at least one of the following: a fuzing component, a data recorder, and a damage mechanism.

13. A method of inserting and mounting a portion of an article inside an internal cavity of a munition, said method comprising the steps of:

(a) providing a munition case having longitudinal centerline, an internal cavity with an inside diameter;

(b) providing a mounting device comprising:

a pedestal for leading the insertion of the mounting device into the internal cavity of the munition; and a skeletal frame having a first end and a second end, wherein said first end is joined to said pedestal, wherein said frame comprises an outermost portion adjacent said second end of said frame, and wherein said outermost portion of said frame has an outer dimension, wherein the outer dimension of said pedestal is less than the outer dimension of said outermost portion of said frame, wherein said skeletal frame comprises a plurality of transverse members and a plurality of longitudinal members, wherein the longitudinal members each have a first end that is joined to the pedestal and a second end that is joined to at least one of the transverse members at the second end of the skeletal frame at a location that is adjacent the outermost portion of said skeletal frame, and wherein said skeletal frame defines an opening therein for holding an article inside said outermost portion of said frame;

(c) positioning an article in the opening defined by the skeletal frame of the mounting device;

(d) inserting said mounting device and article into the internal cavity of the munition case by inserting said pedestal first, wherein the outermost portion of the frame of mounting device centers the article in the internal cavity of the munition; and (e) pouring a liquid explosive material into the internal cavity of said munition case.

14. The method of claim 13 wherein the munition case has an obstruction on its inside surface, and the skeletal frame folds so that said mounting device can be inserted past said obstruction, and expands after it passes the obstruction.

15. The method of claim 13 further comprising stacking a second article onto said mounting device, wherein said method further comprises providing a stacking member having a first end and a second end, said stacking member comprising a second skeletal frame forming the first and second ends of said stacking member, wherein said second skeletal frame defines a second opening therein for holding said second article inside said second skeletal frame, and said method further comprises joining the first end of said stacking member to the second end of the skeletal frame of the first mounting device.

16. A mounting device for inserting and mounting an article inside a cavity within a housing of a munition, which cavity is defined by walls, said mounting device having a first end, a second end, and a longitudinal axis running through the center of the mounting device and aligned with the direction of insertion of the mounting device into the munition, said mounting device comprising:

a pedestal for leading the insertion of the mounting device into a cavity of a munition, said pedestal having an outer dimension, said pedestal having an outwardly-facing surface for inserting first into a cavity of a munition and an opposing inner surface; and a skeletal frame having a first end and a second end, wherein the first end of said skeletal frame is joined to said pedestal, and said skeletal frame comprises an outermost portion adjacent said second end of said skeletal frame, and wherein said outermost portion of said skeletal frame has an outer dimension, wherein the outer dimension of said pedestal is less than the outer dimension of the outermost portion of said skeletal frame, said skeletal frame comprising:

a plurality of wall contacts for contacting the walls defining the cavity of the housing of a munition;

a plurality of transverse rods that are located at the second end of the skeletal frame and have an orientation in which they are oriented substantially perpendicular to the longitudinal axis of the mounting device, said transverse rods each having two ends, wherein one end of each transverse rod is joined to one wall contact;

a plurality of longitudinal rods, each of said longitudinal rods having a first end that is joined to the inner surface of the pedestal, wherein the longitudinal rods are joined to the inner surface of the pedestal at spaced apart locations, and each of said longitudinal rods have a second end that extends toward the second end of the skeletal frame where it is joined to one of said wall contacts; and wherein said skeletal frame defines an opening therein between the transverse rods for holding an article inside said outermost portion of the skeletal frame; and a holder for an article, wherein said holder is joined to the transverse rods at the second end of said skeletal frame.

17. The mounting device of claim 16 wherein the plurality of transverse rods comprises three transverse rods, and said transverse rods have sides that extend between their ends, wherein said transverse rods are arranged in a triangular configuration that lies in a plane substantially perpendicular to the longitudinal axis of the mounting device, wherein the holder for an article is positioned inside the triangular configuration formed by the transverse rods and is joined to the sides of the transverse rods.

18. The mounting device of claim 17 wherein the plurality of longitudinal rods comprises three longitudinal rods having first ends that are joined to the inner surface of the pedestal at spaced apart locations around the pedestal, and the longitudinal rods are angled outwardly away from the longitudinal axis of the mounting device from the first end to the second end of the mounting device.

19. The mounting device of claim 16 wherein the transverse rods and the longitudinal rods have circular cross-sections.

20. The mounting device of claim 16 wherein the plurality of transverse rods each have a proximal end and a distal end, and the transverse rods are spaced apart and extend radially in a direction outward from the longitudinal axis from their proximal ends to their distal ends, and each of the longitudinal rods is indirectly joined at its second end to the distal ends of one of the transverse rods by one of said wall contacts, wherein the holder for an article is positioned along the longitudinal axis of the mounting device, and the distal ends of the transverse rods are joined to the holder.

21. The mounting device of claim 20 wherein the longitudinal rods are flexible.

22. The mounting device of claim 21 wherein the longitudinal rods are flexurally resilient so that they straighten after being bent.

* * * * *